US005394974A

United States Patent [19]

Reist

[11] Patent Number: 5,394,974

[45] Date of Patent: Mar. 7, 1995

[54] METHOD AND APPARATUS FOR THE BUFFER STORAGE OF PRINTED PRODUCTS IN SCALE FORMATION

[75] Inventor: Walter Reist, Hinwil, Switzerland

[73] Assignee: Ferag AG, Hinwil, Switzerland

[21] Appl. No.: 903,954

[22] Filed: Jun. 26, 1992

[30] Foreign Application Priority Data

Jun. 27, 1991 [CH] Switzerland ..... 01905/90

[51] Int. Cl.[6] ..... B65G 47/26

[52] U.S. Cl. ..... 198/418.9; 198/462; 198/644

[58] Field of Search ..... 198/418.9, 462, 460, 198/419.3, 644; 271/270, 151, 202, 216

[56] References Cited

U.S. PATENT DOCUMENTS

| | | | |
|---|---|---|---|
| 3,964,598 | 6/1976 | Alsop | 198/418.9 X |
| 4,549,729 | 10/1985 | Hoffstetter et al. | 271/151 X |
| 4,657,237 | 4/1987 | Hänsch | 271/202 X |
| 5,054,763 | 10/1991 | Achelpohl et al. | 271/202 X |

FOREIGN PATENT DOCUMENTS

| | | |
|---|---|---|
| 580531 | 10/1976 | Switzerland . |
| 631410 | 8/1982 | Switzerland . |

*Primary Examiner*—Cheryl L. Gastineau
*Attorney, Agent, or Firm*—Walter C. Farley

[57] ABSTRACT

Buffer storage of printed products conveyed in scale formation on a conveyor belt (10) is brought about by buffer device (12.1, 12.2, 12.3 etc.), running in a conveying section with a speed which is lower than the speed of the conveyor belt (10) and having a fixed reciprocal spacing and are switched by the printed products to be buffer stored into a state in which they decelerate the printed products and set same to the spacing of the buffer devices. The number of buffer devices on the conveying section is constant and the number of active buffer devices is a function of the number of printed products located on the conveying section provided for buffer storage. The buffer devices can be brake claws, which are arranged centrally between two parallel conveyor belts on a drag chain in such a way that in a lowered, inactive state they are lowered below the conveying surface of the belts, but in their non-lowered, active state project at least partly above the conveying plane. The brake claws are designed in such a way that they are switched by the printed products pulling them up from their lowered, inactive state into their non-lowered, active state.

16 Claims, 3 Drawing Sheets

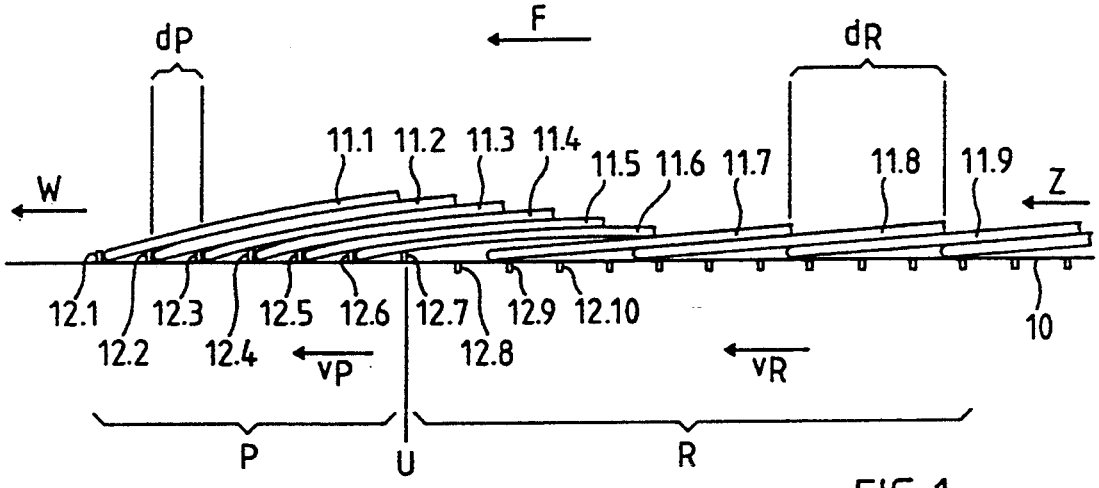
FIG. 1
FIG. 4
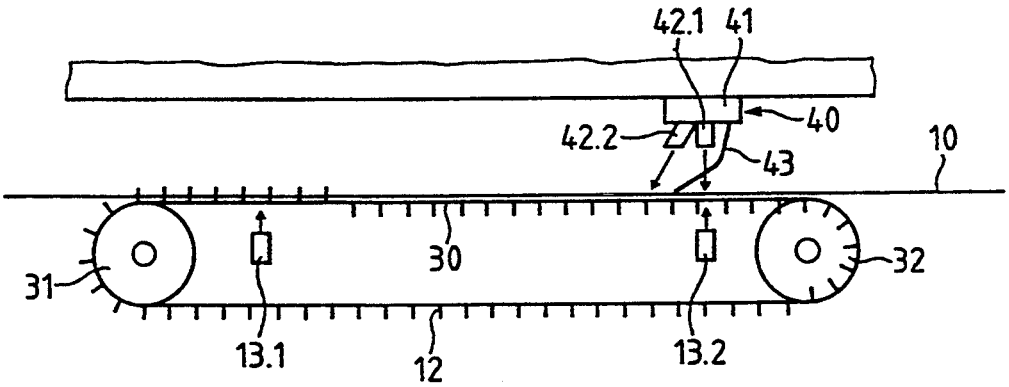

METHOD AND APPARATUS FOR THE BUFFER STORAGE OF PRINTED PRODUCTS IN SCALE FORMATION

FIELD OF THE INVENTION

The invention is in the field of the processing of printed products and relates to a method and an apparatus which serve to, if required, buffer store and time flat products, particularly multilayer, folded printed products in scale formation during conveying on a conveying section provided for buffer storage.

BACKGROUND OF THE INVENTION

Printed products, particularly multilayer, folded printed products are typically spread out by rotary machines or from rolls in scale formation for further processing purposes. For three reasons it is advantageous to have buffer stores or buffers between the laying out of such scale flows and their further processing. It firstly makes it possible to avoid or at least reduce any upstream transmission of problems and systematic irregularities. Secondly, gaps in the flows can be closed and, thirdly, the scale flow can be simultaneously timed. In the case of a fault or problem in further processing, which consequently takes place more slowly or even stops, the buffer store receives the products occurring during an unavoidable reaction time for a supply reaction or even makes it possible to bridge a relatively short processing break by merely slowing down the supply and correspondingly filling of the buffer, which renders unnecessary the stopping and reaccelerating of large masses. If the further processing involves systematic irregularities in such a way that the supplied product is not continuously used for the further processing stage, such as e.g. during personalized insertion, the supply can still continuously supply products to the buffer but with a correspondingly lower capacity. In the case of problem-free, continuous further processing it is still advantageous to operate with a buffer, so that gaps in the supplied scale flow can be eliminated without having any effects on the course of the further processing. Thus, the buffer serves as a collecting or absorbing station for faults and irregularities both upstream and downstream.

Such buffer storage methods and apparatuses are e.g. described in the Applicant's U.S. Pats. Nos. 4,887,809, 4,892,186 and 4,201,286. The buffer systems described therein operate with buffer means (clips, hooks, grippers, brake cams), which over a buffer section of constant length act on the printed products of the scale flow, i.e. convey them more or less actively and the number of buffer means on the buffer section and therefore the distance between the buffer means is variable. The average distance between the buffer means on the buffer section is smaller with a full buffer than with an empty one, because when the buffer is full more buffer means are positioned on the buffer section. Thus, the described buffer systems are based on the idea of a constant length buffer section with a variable spacing between the buffer means. The variable spacing between the buffer means is e.g. brought about by the free mobility of the buffer means along a movement path, in which they are shoved by the following buffer means, or by elastic connections between the buffer means, which are pulled by the leading buffer means.

All the described buffer or buffer storage systems suffer from the disadvantage that they have individually guided elements, which cannot be driven by standard pulling means, such as chains and which must be timed in again after buffer storage and that in most cases the printed products have to be transferred to the buffer means in order to be conveyed over the buffer section, which usually makes it necessary to have special spatial or three-dimensional arrangements. In addition, the described systems require numerous sensors oriented on the printed products not only for measuring the filling state of the buffer for the control of the spreading out and/or further processing, but also for detecting and closing gaps in the supplied scale flow. Such sensors have to be reset e.g. on changing the product format.

SUMMARY OF THE INVENTION

An object of the present invention is to provide a method for the buffer storage of printed products in scale formation, in which the latter does not have to be transformed into another formation and which does not have the disadvantage of known methods of buffer means having a variable spacing. A further object of the invention is to provide an apparatus permitting the performance of the method. The apparatus must be simple to manufacture, universally usable, easy to control and has a reliable fixed timing.

The invention is based on the idea of a buffer with a variable buffer section length and constant spacing between the buffer means compared with the buffers according to the prior art, which have a constant buffer section length and variable spacings between the buffer means. In both cases only that section on which the buffer means act on the printed products is referred to as the buffer section.

According to the inventive method the scale flow is conveyed over the section provided for buffer storage on a conveyor belt, which can easily be incorporated into the conveying paths of other conveyor belts. In order to bring about the variable length of the buffer section, the section provided for buffer storage is functionally subdivided into two partial sections, namely a downstream, effective buffer section and an upstream reverse section, the boundary (transition point) between these two sections moving as a function of the buffer filling state, i.e. the relative length of the two partial sections is variable. When the buffer is full the reserve section has a minimum length, whereas when the buffer is empty the buffer section has a minimum length. The printed products are conveyed over the entire section in scale formation, firstly by means of the conveyor belt over the reserve section and then by means of buffer means or with the joint action of buffer means over the buffer section. The speed and product spacing on the reserve section can be dependent on the supply capacity, the further processing capacity and the filling level of the buffer, whereas the product spacing on the buffer section is fixed and the speed is determined by the further processing capacity. The scale spacings and the speed on the buffer section are always smaller than on the reserve section.

The inventive buffer storage method can best be compared with a liquid buffer in the form of a vessel with an inflow and an outflow and whose level varies as a function of the buffer filling level. The filling level here again has no influence on the characteristics of the liquid in the buffer vessel, the only thing which changes with the degree of filling is the liquid level or in other words the path of the supplied water up to the liquid surface in the buffer vessel (reserve section) and the path of the liquid from said surface to the outlet (buffer section).

The inventive buffer storage system buffer stores a scale flow, without transforming it into another feed flow form and instead, merely by reducing the scale spacing brings it to an invariable length characteristic of the buffer, the buffer length being a function of the number of printed products to be buffer stored. On the conveying section used for buffer storage there are two different printed product spacings, one in each case in the vicinity of two different conveying modes, conveying by means of the conveyor belt on the reserve section and conveying by means of buffer means with or without the joint action of the conveyor belt on the buffer section. In other words, there is no need for buffer means with variable spacing, which constitute an essential component of all the buffer systems according to the prior art and which are the source of most of the disadvantages thereof.

The inventive buffer storage method is brought about by a conveyor belt and the buffer means, both of which pass over the entire section intended for buffer storage, the buffer means only acting on the printed products on the buffer section and are inactive on the reserve section, so that the conveyor belt is solely responsible for conveying on the reserve section. Thus, for performing the inventive method it is necessary to have buffer means with a constant spacing, which act over a variable section on the printed products. According to the invention these buffer means are in such a form that they change their state at the transition point from the reserve section to the buffer section, so that upstream of the transition point they have no effect on the scale flow, but downstream thereof act on the printed products in such a way that the conveying action of the conveyor belt is either completely eliminated or at least reduced.

The inventive buffer means are constructed in such a way that they are switched from the inactive into the active state by a printed product to be buffer stored when it reaches the transition point from the reserve section to the buffer section. Thus, for effective buffer activity there is no need for sensors and the filling level of the buffer can merely be established by means of the active or inactive state of the buffer means at individual points of the section provided for buffer storage and can be further used for the control of the supply and/or further processing capacity. There is in particular no need for sensors oriented on the printed products, which would e.g. have to check whether or not a buffer means conveys a printed product and which would have to be reset in the case of a product format change.

BRIEF DESCRIPTION OF THE DRAWINGS

The invention is described in greater detail hereinafter relative to non-limitative embodiments and the attached drawings, wherein:

FIG. 1 is a schematic side elevation illustrating the method of the invention;

FIG. 4 is a schematic side elevation of a conveying section for buffer storage.

DESCRIPTION OF THE PREFERRED EMBODIMENTS

Figure 2:
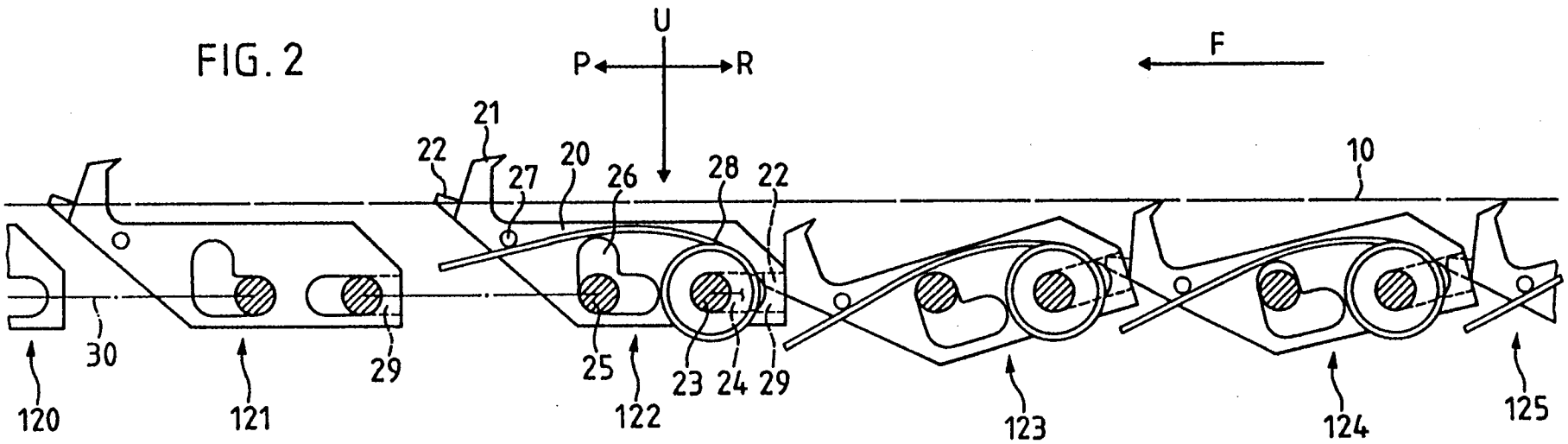
FIG. 2 is an enlarged side elevation of an embodiment of a buffer apparatus in accordance with the invention in its different states.

FIG. 1 shows a diagram for the inventive buffer storage method. It shows a detail from a conveying section provided for buffer storage using a conveyor belt 10, on which conveying takes place in the conveying direction F of a scale flow of printed products 11.1, 11.2, 11.3, etc., together with buffer means 12.1 12.2, 12.3, etc., e.g. in the form of brake cams.

The conveying section provided for buffer storage is functionally subdivided into two partial sections, namely a buffer section P and a reserve section R, the buffer section P being downstream of the reserve section R in the conveying direction. On the reserve section R the printed products (11.7, 11.8, 11.9, etc.) are conveyed by the conveyor belt 10 at a regulatable belt speed $v_R$, and in that section the buffer means (12.8, 12.9, 12.10, etc.) are inactive, e.g. being lowered below the conveyor belt. The spacing $d_R$ between the printed products in the reserve section R is determined by the speed $v_R$ and by the supply capacity (Z) of any selected supply means, not shown.

In buffer section P the product spacings $d_P$ and the speed $v_P$ of the printed products (11.1 to 11.6) are determined by the speed and spacing of the buffer means, because the latter are active in that section and act on the printed products, in that they project above the conveyor belt and brake the printed products, while the latter are still being advanced by the conveyor belt. The spacing $d_P$ between the printed products in buffer section P corresponds to the fixed spacing between the buffer means and the speed $v_P$ is set in accordance with a further processing capacity W of any subsequent processing means, so that the buffer means supply the printed products in correctly timed manner at the outlet of the buffer storage apparatus.

The buffer storage or buffer apparatus has the following function. The speed $v_P$ is set in such a way and during operation regulated in such a way that the delivery capacity of the buffer as closely as possible corresponds to the number of printed products per time unit required by the further processing. As the buffer is a small and consequently a somewhat slow apparatus, without difficulty this speed can be regulated in accordance with the further processing capacity. The conveyor belt speed $v_R$ is set in such a way that it is higher than the speed $v_P$, e.g. by a factor of 2.5 and is sufficiently high that the spacings between the printed products in reserve section R are larger than those in buffer section P. For certain areas of the supply capacity the speed $v_R$ can be set constant or proportional to the speed $v_P$, provided that the aforementioned conditions are fulfilled. However, there must be no coupling between the drives of the conveyor belt and the buffer means, because during a stoppage of the further processing although the buffer means must stop (further processing equal to zero), this does not apply to the conveyor belt, which also in the case of a stoppage can fill the buffer, so that there is no need to stop the supply.

If the scale spacing $d_R$ is smaller than the spacing of the buffer means $d_P$ each buffer means buffer stores more than one product, which can be a desired method variant as a function of the further processing.

If the further processing capacity W and the supply capacity Z are the same (equal number of printed products per time unit, i.e. identical timing) and if the buffer filling level is to be kept constant, the timing in the reserve section and in the buffer section is the same, i.e. each product in the buffer section (or each buffer means anywhere in the conveying section) covers the distance or spacing $d_P$ in the same time as each product in the reserve section covers the distance or spacing $d_R$. Thus, a new product constantly appears at the transition point or station U, if the preceding product with the corresponding buffer means has moved away by the spacing $d_P$ and consequently the next buffer means is located at precisely the same point. This buffer means becomes active and brakes the product in such a way that it moves on at the speed $v_P$. In the case of such an operation the transition station or point between the reserve section R and the buffer section P is always at the same location.

If the supply capacity Z is smaller than the further processing capacity W, then the clock time on the buffer section is longer than on the reserve section, i.e. a buffer means moves by more than the section $d_P$ in the time during which a printed product moves by $d_R$ on the reserve section. Thus, the next product will only reach the transition station U, when the next buffer means has already moved over this point and the corresponding printed product will only subsequently or further downstream meet the same and be braked by it. Therefore the transition station U has moved to the left in the drawing or in other words the buffer section is shorter, the buffer having become emptier. For the case that the supply capacity is higher than the further processing capacity, the buffer will correspondingly be subject to greater filling.

The buffer means are active in the buffer section P, i.e. they act in a product, whereas they are inactive in the reserve section R, i.e. they do not act on the products. A buffer means at the transition station U (the buffer means 12.7 in the drawing) must be active to the extent that it must brake the next product, but as yet acts on no product and is consequently still inactive, but is "ready". Therefore the buffer means must be designed in such a way that they can assume three states, namely inactive (on the reserve section), active (on the buffer section) and ready (at the transition point or station). According to the invention an inactive buffer means at the transition point is already switched in that the preceding buffer means has switched from ready to active. A ready buffer means is switched active on entering the buffer section, because a printed product strikes against it and is braked. Thus, in the entire section there are always a number of inactive buffer means (reserve section), a ready buffer means (transition point) and a number of inactive buffer means (buffer section), the relative numbers being dependent on the number of printed products in the entire section. Both the conveyor belt and the buffer means from the end of the buffer section (transfer of the products to further processing) are moved back to the start of the reserve section on a return side or strand. During this return strand the buffer means must be switched from active to inactive.

Speeds and product spacings in the inventive buffer system must be set in such a way that each conveyed printed product strikes a buffer means before the end of the buffer section, so that it can be delivered by it in precisely timed manner to the further processing, i.e. the buffer section must always have at least one active buffer means. This is advantageously ensured in that each buffer means is reliably switched active at the outlet from the buffer section, e.g. by the action of the reversal of the return strand. Only in this way can the buffer system simultaneously act as a timer able to a limited extent to compensate for irregularities in the supplied scale flow and only in this way is it ensured that after the conveying section provided for buffer storage has completely run empty or after the buffer has become empty, the buffer storage function can automatically be resumed.

The inventive buffer system also automatically closes gaps in the supplied scale flow. As in the case of such a gap no product for a longer time strikes against the ready buffer means (transition point), it will move further towards the buffer outlet before being switched to active, i.e. the transition station will move to the left in the drawing or the buffer will lose fullness, but otherwise the gap will have no effect on the buffer storage or further processing, provided that an adequate buffer store is present.

When functioning with brake cams lowerable below the conveyor belt as buffer means, the inventive method requires a scale flow, in which the leading edges of the printed products are directed downwards, i.e. in which in each case one product is partly covered by the preceding products. In such a flow it is not possible to close gaps, which are wider than the overlap of two products by just shoving over, as would be the case in the described method without special aids. As in the case of such a large gap the products no longer rest on one another, for closing the gap the following product must be moved under the preceding product and for this purpose corresponding aids are required.

Figure 3:
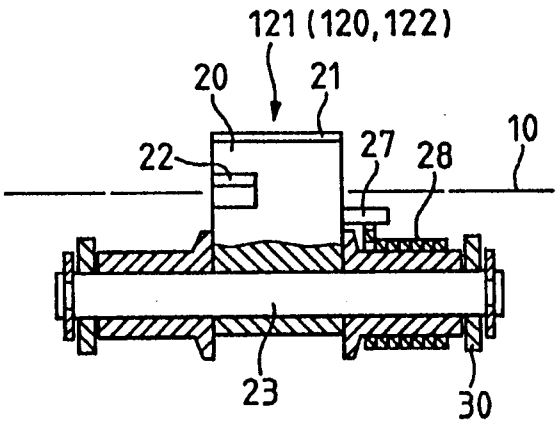
FIG. 3 is a transverse sectional view of a buffer apparatus perpendicular to the direction of view of FIG. 2.

FIGS. 2 and 3 show in detail an embodiment of buffer means according to the invention, in a view at right angles to the conveying direction (FIG. 2) and sectioned as a view against the conveying direction. Brake claws can be lowered below the conveyor belt 10, if they are not lowered, it stops the printed products in the central area of their downwardly directed leading edges and decelerates them to the lower speed of the buffer means from that of the conveyor belt on which they are moving. The conveyor belt can be in the form of two parallel partial belts and in the central gap between the two partial belts a drag chain 30 with brake claws is positioned in such a way that the claws in the active and ready (not lowered) state extend above the conveying surface of the conveyor belt, but are below the conveying surface in the inactive, lowered state.

In both drawings the conveyor belt 10 is only indicated by a level line, which designates its conveying surface. The drag chain 30 is indicated as a broken line.

FIG. 2 shows a row of four inventive buffer means in the form of brake claws 121, 122, 123, 124 (120 and 125 only partly shown), which move in the conveying direction F from right to left driven by a drag chain 30 (indicated in FIG. 3). Brake claw 121 is in its active state, brake claw 122 in its ready state and the two rear brake claws 123, 124 in the inactive state, so that what is shown is the transition point or station U from the reserve section R to the buffer section P. FIG. 3 shows a brake claw in its active or ready state (121, 120 or 122).

Each brake claw comprises a claw body 20, in which are mounted in rotary manner in two guides 24, 26 two link pins 23, 25. The guide 24 of the link pin 23, which is at the rear in the conveying direction is slot-like, whereas the guide 26 of the front link pin 25 in the conveying direction is in the form of an angular slot, so that the claw body 20 can move in limited manner relative to the link pins 23 and 25 laterally substantially parallel to the conveying direction and can be pivoted about the rear link pin 23 in its rear position with respect to its lateral movement. This pivoting movement is so limited by the front guide 26, that in an upper extreme position of a claw 21 fitted at the front to the claw body 20, it projects above the conveyor belt, whereas in the lower extreme position of the claw 21 it is lowered below the conveyor belt.

By a force or tension means, e.g. a spring, the claw 21 is pressed into its upper position and the claw body 20 into its rear position. The spring 28 can e.g. be a helical spring arranged around the link pin, which with the aid of two ends passing out of the helical shape is fixed between the chain and a corresponding spring cam 27 on the claw body 20. The force means can also be a permanent magnet, which is so arranged in the front, lower region of the claw body 20, that the claw 21 is drawn into its upper pivoting position by the magnetic attraction between the magnet and the link pin 25 and the claw body 20 is drawn into its rear position.

In the conveying direction the claw body 20 carries the claw 21 at the front as well as a retaining cam 22, as well as at the rear an indentation 29. The two guides 24, 26 are arranged in the claw body in such a way that the axis of the pivoting movement (link pin 23) is well to the rear, so that in the case of a pivoting movement the position change of the claw 22 and the retaining cam 21 is much greater than that of the indentation 29.

The brake claws are so dimensioned and arranged on the drag chain 30 that they overlap in the conveying direction in a linear conveying section. This overlap permits an interaction between the retaining cams 22 on the fronts of the claw bodies 20 with the corresponding indentations 29 on the rear of the leading claw body 20, but only if the retaining cams 22 and indentation 29 are substantially at the same level, which is the case if the claw 21 is in its lower pivoting position. The pivoting position of the indentation 29 is unimportant, i.e. a retaining cam 22 pivoted into the lower position can interact with an indentation 29 of a leading brake claw with downwardly or upwardly pivoted claw 21. The overlap of the claw bodies in the conveying direction is smaller than the size of the lateral movement which can be performed by a claw body.

The claw 21 is forced by the spring 28 into its upper pivoting position if not kept in the lower pivoting position by the interaction of the retaining cam 22 with the indentation 29 of a leading brake claw. A brake claw with claw 21 in its upper position can be moved from the rear into the front position by a printed product striking it at high speed from the rear.

The brake claws 20 have three possible extreme positions.

The claw body 20 is in its front position, the claw 21 is pivoted upwards (121) by the tension of the spring 28. This is the active state of the brake claw (121). An interaction between the retaining cam 22 and the indentation 29 of a leading brake claw (120) is not possible, because they are not at the same level. An interaction of the indentation 29 with the retaining cam 22 of a following brake claw (122) is not possible, because the following brake claw must be in its front position with downwardly pivoted claw 21, a position which it cannot assume.

The claw body 20 is in its rear position and the claw 21 is pivoted upwards (122) by the tension of the spring 28. This is the ready state of the brake claw (122). An interaction between the retaining cam 22 and the indentation 29 of the leading brake claw (121) is not possible, because they are not at the same level. A following brake claw (123) can only be in its rear position and an interaction between the indentation 29 and the retaining cam 21 of said following brake claw is possible if its claw is in the lower pivoting position.

The claw body 20 is in its rear position and the claw 21 by the pressure of the retaining cam 22 of a following brake claw is pivoted downwards against the tension of the spring 28 (123 or 124). This is the inactive state of the brake claw (123 or 124). An interaction between the retaining cam 22 and the indentation 29 of a leading brake claw (122 or 123) is only possible if it is also in its rear position, i.e. there is no interaction between the claws 121 and 122, but there is interaction between 122 and 123 as well as between 123 and 124. A following brake claw (124 or 125) can only be in its rear position and an interaction between the indentation 29 and the retaining cam 22 of said following brake claw (124 or 125) is necessary to keep the brake claw 123 or 124 in this position.

The brake claws move in the inactive state through the reserve section R and in the active state over the buffer section P. The following takes place at the transition point U. The already buffer stored printed products are decelerated by the brake claws and move in the conveying direction at a speed lower than that of the conveyor belt towards the end of the buffer section. The last brake claw with printed products of the buffer section is followed by a now observed brake claw. A next printed product is moved at the conveyor belt speed from the rear against the observed brake claw and strikes against the same. The observed brake claw has an upwardly pivoted claw 21, because the leading brake claw was moved into its front position by the last printed product of the buffer section and consequently an interaction is no longer possible between the observed brake claw and the leading brake claw. As a result of the deceleration of the printed product now striking the observed brake claw this is also moved into its front or active state, so that the interaction with the following brake claw is eliminated and the claw 21 of said following brake claw is moved into its upper position or ready state. The switching process from the inactive into the ready and from the ready into the active state at the transition point is consequently only initiated by the printed products and requires no external control and therefore no sensors.

For as long as the buffer store correctly functions, each brake claw passes the end of the buffer section in its active state. This is so for as long as the buffer store contains at least one printed product. If the buffer store runs empty, e.g. due to an inadequate supply capacity or when there is an interruption of supply, it is indispensable for automatic resumption of the buffer function for the brake claws at the end of the buffer section, even without printed products to be buffer stored, to be switched into the active state. This is achieved by a corresponding design of the deflection or reversal point, which reverses the brake claws on the return strand. The reversal radius of the interaction point must be larger than the reversal radius of the link pin, so that no interaction is possible during reversal.

During the reversal following the end of the buffer section, during the return strand or during the reversal to the start of the reserve section, the brake claws must be repositioned in such a way that they enter the reserve section in the inactive state. This is e.g. achieved in that during the reversal following the end of the buffer section by a corresponding movement template they are moved into the rear state and during the reversal at the start of the reserve section are moved with another template into the lower pivoting point of the claw, so that they are held by the template in the inactive state until the interaction occurs on the linear reserve section. In this way the brake claws traverse the return strand in the ready state, which is only possible on the forward section for one brake claw. It would also be possible to move the brake claws in the active state through the return strand and position the corresponding template at the second deflection or reversal point.

Brake claws carrying a magnet in place of a spring 28 (FIG. 2), for restoring the inactive state at the reversal points can be guided by means of corresponding steel links, which are constructed in such a way that the magnetic attraction between the permanent magnet and the steel link is greater than the magnetic attraction between the permanent magnet and the link pin and that in the vicinity of the first reversal or deflection magnetic forces occur which bring the brake claws into their rear position and at the second reversal or deflection in such a way that magnetic forces occur which pivot the brake claws into the pivoting position in which the claw is at the bottom.

As shown in FIG. 3, the inventive brake claws can be arranged centrally on the link pin, i.e. between the chain side bars, or on one side, i.e. below the chain side bars. In the case of a lateral arrangement the brake claws can be installed by fitting on. It is possible to use commercially available chains. The brake claws are advantageously made from plastic.

In place of brake claws it is also possible to use grippers as buffer means. If brake claws are used as buffer means, it is advantageous to slightly lower the section provided for buffer storage, but it can also be horizontal, but must not rise. If grippers are used as the buffer means, there are no restrictions with regards to the position of the conveying section used for buffer storage.

FIG. 4 diagrammatically shows a complete conveying section equipped for buffer storage, which also has the auxiliary device necessary for closing larger gaps in the scale flow. FIG. 4 illustrates how a corresponding apparatus is monitored and controlled. Parts mentioned in conjunction with the previous drawings are given the same reference numerals.

The conveyor belt 10 runs over two guide rolls (not visible in the drawing). The tension or pulling member 30 with the buffer means 12 also runs over two guide rolls 31, 32. An auxiliary device 40 for closing larger gaps in the scale flow entering the buffer store is located over the conveying section (forward strand of the buffer means) equipped for buffer storage.

In the vicinity of the conveying section (forward strand of the conveyor belt 10) equipped for buffer storage there are at least two sensors 13.1 and 13.2 in the vicinity of the entrance of the reserve section and in the vicinity of the outlet from the buffer section, which produce signals for establishing the state of the passing buffer means. These are e.g. light barrier sensors, which, as a function of the state, may or may not be interrupted by parts of the buffer means. If the outlet sensor 13.1 indicates inactive buffer means, this means that there has been a drop below the minimum acceptable buffer filling. If the inlet sensor 13.2 indicates active buffer means, this means that the maximum acceptable buffer filling has been exceeded. From such indications of the sensors 13.1 and 13.2 control signals are produced for increasing or decreasing the supply capacity and/or increasing or decreasing the processing capacity and corresponding control signals for changing the speeds $v_P$ of the buffer means and/or $v_R$ of the conveyor belt. It is also possible to provide more than two sensors and the controls can be correspondingly stepwise performed. The indications of the sensors 13.1 and 13.2 and corresponding additional sensors can also be used for detecting malfunctions.

The auxiliary device 40 has a slide 41 movable over the entire conveying section, which carries two sensors 42.1 and 42.2, as well as a lever or jack 43. The two sensors 42.1 and 42.2 are constructed in such a way that they detect interruptions in the scale flow (gaps larger than the overlap of the printed product), the rear sensor 42.1 in the conveying direction detecting the start of a gap and the front sensor 42.2 in the conveying direction the end of such a gap. The lever 43 is constructed in such a way that if guided in the conveying direction over an interruption in the scale flow, it engages under the product conveyed upstream of the interruption and raises it from the conveyor belt and that on guidance against the conveying direction it can be drawn above the products without displacing the same. For this purpose the lever 43 is arranged in such a way that in the inoperative position its end is positioned directly over the conveyor belt and in the conveying direction can be pivoted out of this inoperative position. The lever 43 is positioned in such a way that its end is located between the areas of the two sensors 42.1 and 42.2.

The auxiliary device has the following function. Its starting position is the entrance to the conveying section. As soon as the rear sensor 42.1 discovers the start of an interruption, the auxiliary device is brought into the readiness state. As soon as the interruption passes into the vicinity of the front sensor 42.2, the slide 41 moves at the same speed as the interruption and printed products in the conveying direction and consequently always remains over the interruption. It moves until it reaches the buffer stored products, or more precisely the rear sensor 42.1 is positioned over the buffer stored products, i.e. no longer sees an interruption. This means that the end of the lever has already raised the buffer stored products or at least the rear edge of the last product and that there has been a pass below the product following the interruption. The slide stops its forward movement and from there is moved back into its starting position. If it detects the next interruption on its path, the procedure is the same. The slide 41 is driven by an electric, pneumatic or hydraulic linear motor.

Figure 5:
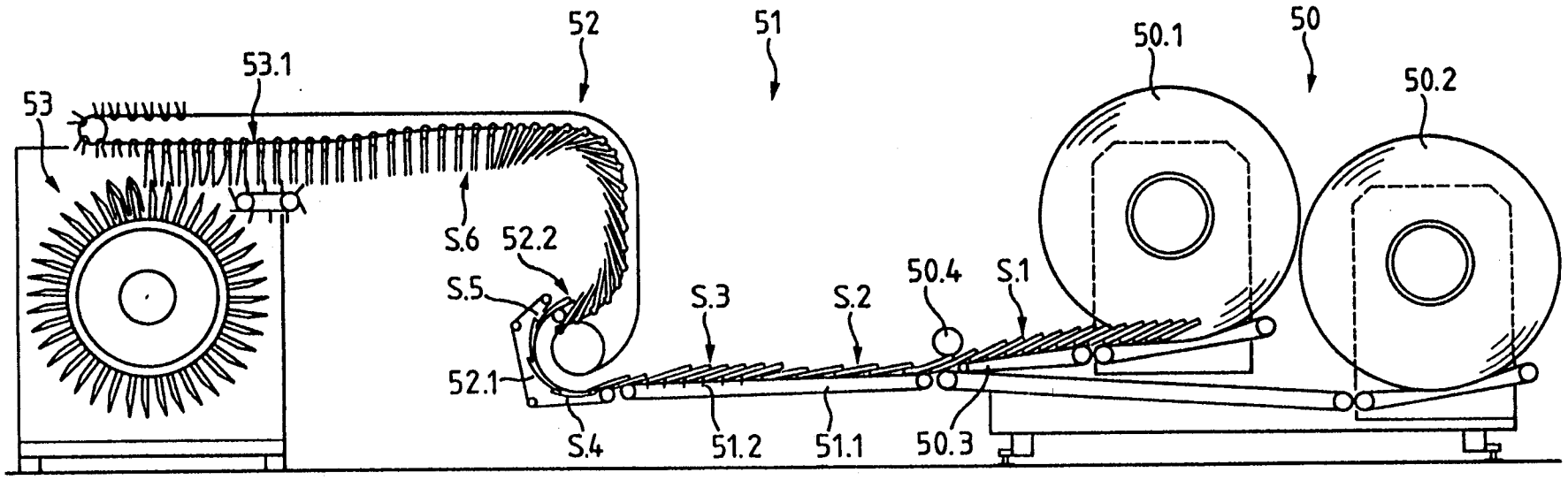
FIG. 5 is a schematic side elevation of an installation incorporating buffer storage apparatus according to the invention.

FIG. 5 shows a use example for the inventive buffer method and apparatus. It relates to the supply to a collecting drum 53 from a winding station 50 with two rolls 50.1 and 50.2, whereof one is unwound (50.1), whereas on the other winding position (50.2) an empty roll core can be replaced by a new roll. The inventive apparatus 51 is connected between the winding station 50 and a transfer station 52. The scale flow S.1 spread out by the unwinding roll 50.1 is guided on a conveyor belt 50.3 to the buffer apparatus 51. In most cases the speed of the supply belt 50.3 is lower than the speed of the buffer belt 51.1, so that the scale flow S.1 on passing from the supply belt 50.3 to the buffer belt 51.1 is drawn apart to a scale flow S.2 with larger scale spacings. At this transition point it is advantageous to press the scale flow with a pressure roller 50.4 or pressure belt onto the conveyor belts. The scale flow S.2 passes through the buffer apparatus 51, in that as a function of the buffer filling level it is decelerated earlier or later by the buffer means 51.2 and set to a smaller scale spacing S.3. At the outlet from the buffer the printed products are guided into a transfer station 52, the scale flow S.3 at the transfer point being drawn apart again to a scale flow S.4 with a larger scale spacing. It is also advantageous at this transfer point to press the printed products by means of a pressure roller or belt (not shown in the drawing) onto the conveyor belt. The scale flow S.4 is then reversed to a scale flow S.5 with the reversed position of the printed products and then is transformed into a feed flow S.6 with grippers, in that the individual printed products are transferred to corresponding grippers. The feed flow S.6 with grippers is then guided on the collecting drum 53, where the printed products are collected into different printed product groups.

It is not vital that the conveying section traversed by the buffer means 51.2 and the conveyor belt 51.1 have the same length. It is conceivable for the conveyor belt 51.1 to be longer than the pulling member of the buffer means and to project upstream of the latter. The conveying section provided for buffer storage is only as long as the conveying section with buffer means, the start of the conveying section of the conveyor belt being merely a supply section.

Winding stations suitable for the use of the inventive apparatus shown in FIG. 5 are e.g. described in U.S. Pat. No. 4,898,336, corresponding transfer stations in U.S. Pat. No. 4,201,286 and corresponding collecting drums in U.S. Pat. No. 4,684,116 of the same Applicant.

I claim:

1. A method for the buffer storage of printed products comprising the steps of conveying a plurality of printed products in scale formation on a conveyor with the leading edges of the products adjacent the conveyor and the trailing edges lying on a following product at a speed $v_R$ through a first part of a region provided for buffer storage, the scale formation having a first scale distance, decelerating the products at a transition point in the region by braking the leading edge of each product with one of a series of equidistant buffer elements acting from below the conveyor to a speed $v_P$, where $v_P < v_R$, to form a scale formation with a scale distance determined by the distances between buffer elements and smaller than the first scale distance, and conveying the products through a second part of the region after the transition point, the location of the transition point along the conveying direction in the region being displaced automatically as a function of the number of products in the second part of the region.

2. A method according to claim 1 wherein said buffer elements are in an inactive state below said conveyor at the beginning of the first part, the method including switching the buffer elements to a ready state and then to an active state by engagement with the printed products.

3. A method according to claim 2 wherein buffer elements in the inactive state interengage each other, the switching including separating the buffer elements from each other so that the interengagement is removed when a printed product catches up to a buffer element.

4. A method according to claim 3 wherein the switching includes switching each buffer element from an inactive state to a ready state when a preceding buffer element switches from a ready state to an active state, and switching each buffer element, in turn, from a ready state to an active state as a printed product moving faster than the buffer element catches up to and engages a claw portion of the buffer element in the ready state.

5. A method according to claim 1 and including monitoring a degree of fullness of the region by monitoring at least two points along a path traversed by the buffer elements.

6. A method according to claim 5 and including mechanically switching to a ready state each buffer element not already in a ready or active state without the aid of printed products at the end of the first part so that the elements are prepared to function after a temporary absence of printed products on the conveyor.

7. A method according to claim 6 wherein the buffer elements are driven along a path paralleling the conveyor and then return to a starting point along a reverse path, and including switching each buffer element to an inactive state along the reverse path.

8. An apparatus for the buffer storage of printed products comprising the combination of conveyor means for transporting a scale flow of printed products along a path in a conveyance direction and at a predetermined speed, said conveyor means including two parallel, partial conveyor belts separated by an intermediate gap;

a plurality of buffer elements substantially equidistantly spaced along at least a portion of said path, each said buffer element including a claw movable between an inactive state in which said claw is below said path, a ready state in which said claw is in said path and an active state in which said claw is engaged by a printed product in said scale flow; and pulling means for moving said buffer elements in said conveyance direction at a speed less than said predetermined speed, whereby each said buffer element engaged by a printed product decelerates said printed product, said pulling means comprising a pulling member including a drag chain adjacent and below said gap carrying said buffer elements so that said elements can act from below printed products carried by said belt, and wherein each of said buffer elements is pivotably attached to said drag chain.

9. An apparatus for the buffer storage of printed products comprising the combination of conveyor means for transporting a scale flow of printed products along a path in a conveyance direction and at a predetermined speed with a leading edge of each printed product adjacent a conveying surface of said conveyor means;

a plurality of buffer elements substantially equidistantly spaced along at least a portion of said path; and pulling means below said conveyor means for moving said buffer elements in said conveyance direction at a speed less than said predetermined speed, each said buffer element including a body pivotably attached to said pulling means and having an extension overlapping a next adjacent buffer element body in said conveyance direction, and means attached to said body below said path and movable upwardly to be engaged by a printed product in said scale flow, whereby each said buffer element engaged by a printed product decelerates said printed product.

10. An apparatus according to claim 9 wherein said means movable upwardly comprises a brake claw, said body being pivotable between an inactive position in which said claw is below said conveyor means and a ready and active position in which said claw projects into said path.

11. An apparatus according to claim 10 and including means for guiding said buffer elements along a path paralleling the conveyor in the conveyance direction, reversing the direction of buffer element travel and along a reverse path to a starting point, and for switching each buffer element to an inactive state at a point of direction reversal.

12. An apparatus according to claim 11 wherein said means for switching includes templates.

13. An apparatus according to claim 9 and further comprising means for sensing and closing interruptions in said scale flow, said means for sensing and closing being mounted above said conveyor means, said pulling means and said buffer elements.

14. An apparatus according to claim 13 wherein said means for sensing and closing includes a slide movable substantially parallel with said conveyance direction above said conveyor means, first and second sensors directed toward said scale flow and a lever extending into said path, said sensors and said lever being carried by said slide.

15. An apparatus according to claim 9 wherein said pulling means comprises a pulling chain having a plurality of successive link pins and wherein each said body includes front and rear guide means coupled to successive ones of said link pins, said guide means being shaped to permit limited longitudinal motion relative to said chain and pivotal motion about one of said pins, an extension at one end of said body and a mating recess at the other end so that the extension of one body is insertable into the recess in an adjacent body, said means for engaging comprising a claw extending upwardly from said body to lie in said path, and means for urging said claw on a body upwardly when the recess in that body is disengaged from the extension on an adjacent body.

16. An apparatus according to claim 15 wherein said means for urging comprises a spring acting between said chain and said body.

* * * * *